US011578880B2

(12) United States Patent
Yamada et al.

(10) Patent No.: US 11,578,880 B2
(45) **Date of Patent: *Feb. 14, 2023**

(54) SYSTEM AND METHOD FOR HEATING AND COOLING

(71) Applicants: Daikin Industries, Ltd., Osaka (JP); Goodman Manufacturing Company, L.P., Waller, TX (US)

(72) Inventors: Miki Yamada, Osaka (JP); Junichi Shimoda, Osaka (JP); Takamune Okui, Osaka (JP); Yuko Ishida, Osaka (JP); Joseph Kelly Hearnsberger, Katy, TX (US); David Palazzolo, Houston, TX (US); Sriram Venkat, Katy, TX (US)

(73) Assignee: Daikin Industries, Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/720,828

(22) Filed: Apr. 14, 2022

(65) Prior Publication Data

US 2022/0235949 A1 Jul. 28, 2022

Related U.S. Application Data

(63) Continuation of application No. 16/250,951, filed on Jan. 17, 2019, now Pat. No. 11,313,568.

(60) Provisional application No. 62/619,779, filed on Jan. 20, 2018.

(51) Int. Cl.

| | |
|---|---|
| ***F24F 3/08*** | (2006.01) |
| ***F24F 1/00*** | (2019.01) |
| ***F24F 3/00*** | (2006.01) |

(52) U.S. Cl.
CPC ..... *F24F 3/08* (2013.01); *F24F 1/00* (2013.01); *F24F 2003/008* (2013.01)

(58) Field of Classification Search
CPC ..... F24F 3/08; F24F 1/00; F24F 2003/008
See application file for complete search history.

(56) References Cited

U.S. PATENT DOCUMENTS

| | | | |
|---|---|---|---|
| 7,472,744 | B2 | 1/2009 | Gorbounov |
| 8,849,613 | B2 | 9/2014 | Caillat |
| 9,651,314 | B2 | 5/2017 | Lee |
| 9,664,455 | B2 | 5/2017 | Lee |
| 9,664,456 | B2 | 5/2017 | Lee |
| 9,714,795 | B2 | 7/2017 | Lee |
| 9,759,456 | B2 | 9/2017 | Hancock |
| 9,791,218 | B2 | 10/2017 | Lee |
| 10,151,502 | B2 | 12/2018 | Flaherty |
| 10,330,364 | B2 | 6/2019 | Harkins |
| 10,571,176 | B2 | 2/2020 | Han |

(Continued)

*Primary Examiner* — Jon T. Schermerhorn, Jr.
(74) *Attorney, Agent, or Firm* — Manish Vyas; Ross E. Apffel; James Willson

(57) ABSTRACT

An HVAC system is provided. Embodiments of the present disclosure generally relate to heat exchangers having tubing with a reduced diameter compared to traditional systems. In one embodiment, a ducted HVAC system comprises an outdoor heat exchanger with tubing that has an outer diameter of eight millimeters (8 mm) or less and an indoor heat exchanger with tubing that has an outer diameter of nine millimeters (9 mm) or less. Additional systems, devices, and methods are also disclosed.

14 Claims, 9 Drawing Sheets

(56) References Cited

U.S. PATENT DOCUMENTS

| | | | | |
|---|---|---|---|---|
| 2008/0110608 | A1* | 5/2008 | Gorbounov | F28F 9/185 165/173 |
| 2011/0129354 | A1* | 6/2011 | Caillat | F04B 49/065 417/1 |
| 2013/0061629 | A1* | 3/2013 | Leistner | F25B 15/10 62/490 |
| 2013/0199762 | A1 | 8/2013 | Lee | |
| 2014/0033743 | A1* | 2/2014 | Hancock | F25B 27/02 62/238.1 |
| 2015/0370927 | A1* | 12/2015 | Flaherty | F24F 11/64 703/1 |
| 2015/0377533 | A1* | 12/2015 | Harkins | C09K 5/045 62/529 |
| 2016/0245570 | A1* | 8/2016 | Han | F25B 49/022 |

* cited by examiner

SYSTEM AND METHOD FOR HEATING AND COOLING

CROSS REFERENCE TO RELATED APPLICATIONS

This application is a continuation of U.S. patent application Ser. No. 16/250,951, entitled "System and Method for Heating and Cooling," filed on Jan. 17, 2019, which claims priority to and benefit of U.S. Provisional Patent Application No. 62/619,799, entitled "System and Method for Heating and Cooling," filed on Jan. 20, 2018, each of which are herein incorporated by reference in their entirety.

BACKGROUND

This section is intended to introduce the reader to various aspects of the art that may be related to various aspects of the presently described embodiments—to help facilitate a better understanding of various aspects of the present embodiments. Accordingly, it should be understood that these statements are to be read in this light, and not as admissions of prior art.

Modern residential and industrial customers expect indoor spaces to be climate controlled. In general, heating, ventilation, and air-conditioning ("HVAC") systems circulate an indoor space's air over low-temperature (for cooling) or high-temperature (for heating) sources, thereby adjusting the indoor space's ambient air temperature. HVAC systems generate these low- and high-temperature sources by, among other techniques, taking advantage of a well-known physical principle: a fluid transitioning from gas to liquid releases heat, while a fluid transitioning from liquid to gas absorbs heat.

Within a typical HVAC system, a fluid refrigerant circulates through a closed loop of tubing that uses compressors and other flow-control devices to manipulate the refrigerant's flow and pressure, causing the refrigerant to cycle between the liquid and gas phases. Generally, these phase transitions occur within the HVAC's heat exchangers, which are part of the closed loop and designed to transfer heat between the circulating refrigerant and flowing ambient air. As would be expected, the heat exchanger providing heating or cooling to the climate controlled space or structure is described adjectivally as being "indoors," and the heat exchanger transferring heat with the surrounding outdoor environment is described as being "outdoors."

The refrigerant circulating between the indoor and outdoor heat exchangers—transitioning between phases along the way—absorbs heat from one location and releases it to the other. Those in the HVAC industry describe this cycle of absorbing and releasing heat as "pumping." To cool the climate-controlled indoor space, heat is "pumped" from the indoor side to the outdoor side. And the indoor space is heated by doing the opposite, pumping heat from the outdoors to the indoors.

The amount of refrigerant employed by the HVAC system to perform this pumping is partially defined by the total volume of the loop's tubing, a significant portion of which is comprised of the heat exchangers' tubing. And as the employed refrigerant amount increases, it generally increases the size of certain associated equipment within the HVAC system, increasing the system's cost, weight and overall dimensions, for example.

In particular, "ducted" systems—which are common in North America, and in which ambient air in a structure is circulated over a central indoor heat exchanger and then routed back through relatively large ducts (or ductwork) to multiple climate-controlled indoor spaces—have indoor heat exchangers with relatively large diameter tubing (e.g., ⅜ inch or 9.525 millimeters). That, in turn, can increase the overall amount of refrigerant employed by the HVAC system, and its costs and dimensions.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to heat exchangers having tubing with a reduced diameter compared to traditional systems. In one embodiment, a ducted HVAC system comprises an outdoor heat exchanger with tubing that has an outer diameter of eight millimeters (8 mm) or less and an indoor heat exchanger with tubing that has an outer diameter of nine millimeters (9 mm) or less. Advantageously, reducing the tubing diameter of the heat exchangers as described reduces the amount of refrigerant employed by the system—which, in turn, reduces the size of certain associated equipment within the HVAC system, like the receiver or accumulator, reducing the system's overall cost and/or size, for example.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present disclosure will be described below. In an effort to provide a concise description of these embodiments, all features of an actual implementation may not be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Figure 1:
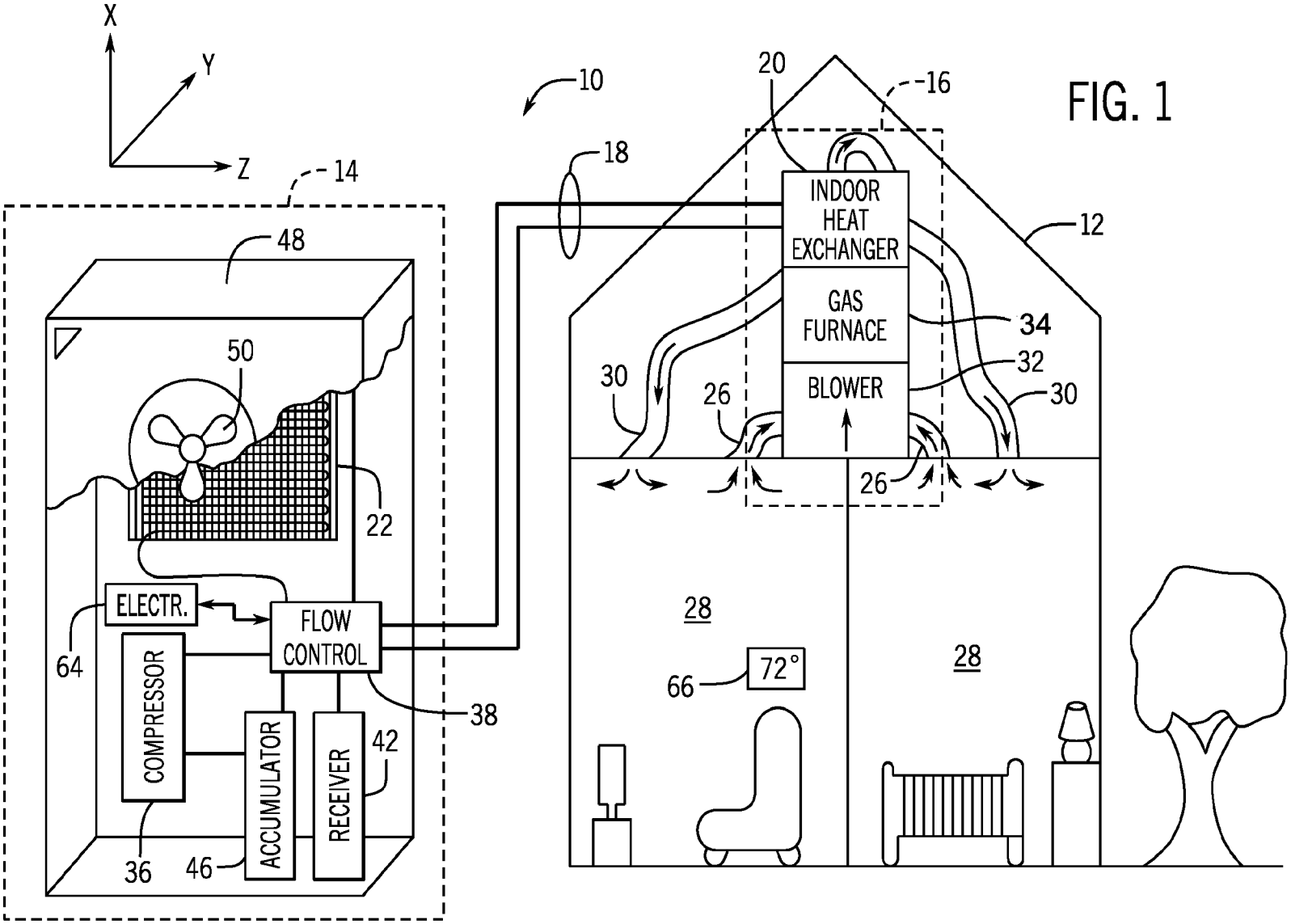
FIG. 1 illustrates schematically an HVAC system for heating and cooling indoor spaces within a structure, in accordance with an embodiment of the present disclosure.

Turning now the figures, FIG. 1 illustrates an HVAC system 10 in accordance with one embodiment. As depicted, the system 10 provides heating and cooling for a residential structure 12. But the concepts disclosed herein are applicable to a myriad of heating and cooling situations, including industrial and commercial settings.

The described HVAC system 10 divides into two primary portions: The outdoor unit 14, which mainly comprises components for transferring heat with the environment outside the structure 12; and the indoor unit 16, which mainly comprises components for transferring heat with the air inside the structure 12. To heat or cool the illustrated structure 12, the indoor unit 16 has an air-handler unit (or AHU) that is an airflow circulation system, which in the illustrated embodiment draws ambient indoor air via returns 26, passes that air over one or more heating/cooling elements (i.e., sources of heating or cooling), and then routes that conditioned air, whether heated or cooled, back to the various climate-controlled spaces 28 through ducts or ductworks 30—which are relatively large pipes that may be rigid or flexible. A blower 32 provides the motivational force to circulate the ambient air through the returns 26, AHU, and ducts 30.

As shown, the HVAC system 10 is a "dual-fuel" system that has multiple heating elements. A gas furnace 34 located downstream (in terms of airflow) of blower 32 combusts natural gas to produce heat in furnace tubes (not shown) that coil through the furnace. These furnace tubes act as a heating element for the ambient indoor air being pushed out of the blower 32, over the furnace tubes, and into the ducts 30. However, the furnace is generally operated when robust heating is desired. During conventional heating and cooling operations, air from the blower 32 is routed over an indoor heat exchanger 20 and into the ductwork 30. The blower, gas furnace, and indoor heat exchanger may be packaged as an integrated AHU, or those components may be modular. Moreover, it is envisaged that the positions of the gas furnace and indoor heat exchanger and blower can be reversed or rearranged.

The indoor heat exchanger 20 can act as a heating or cooling element that add or removes heat from the structure, respectively, by manipulating the pressure and flow of refrigerant circulating within and between the indoor and outdoor units via refrigerant lines 18. But that is just one embodiment. It is also envisaged that the refrigerant could be circulated to only cool (i.e., extract heat from) the structure, with heating provided independently by another source—like a gas furnace, for example. Or there may be no gas heating. Or in another embodiment there may be no heating of any kind. HVAC systems that use refrigerant to both heat and cool the structure 12 are often described as heat pumps, while systems that use refrigerant only for cooling are commonly described as air conditioners.

Whatever the state of the indoor heat exchanger (i.e., absorbing or releasing heat), the outdoor heat exchanger 22 is in the opposite state. More specifically, if heating is desired, the illustrated indoor heat exchanger 20 acts as a condenser, aiding transition of the refrigerant from a high-pressure to gas to a high-pressure liquid and releasing heat in the process. And the outdoor heat exchanger 22 acts as an evaporator, aiding transition of the refrigerant from a low-pressure liquid to a low-pressure gas, thereby absorbing heat from the outdoor environment. If cooling is desired, the outdoor unit 14 has flow-control devices 38 that reverse the flow of the refrigerant such that the outdoor heat exchanger acts as a condenser and the indoor heat exchanger acts as an evaporator. To facilitate the exchange of heat between the ambient indoor air and the outdoor environment in the described HVAC system 10, the respective heat exchangers 20, 22 have tubing that winds or coils through heat-exchange surfaces, to increase the surface area of contact between the tubing and the surrounding air or environment. As a result, a substantial portion of the tubing that comprises the refrigerant loop is found in the heat exchangers.

In the illustrated embodiment, the outdoor unit 14 is a side-flow unit that houses, within a plastic or metal casing or housing 48, the various components that manage the refrigerant's flow and pressure. This outdoor unit 14 is described as a side-flow unit because the airflow across the outdoor heat exchanger 22 is motivated by a fan that rotates about an axis that is non-perpendicular with respect to the ground. In contrast, traditional "up-flow" devices generate airflow by rotating a fan about an axis generally perpendicular to the ground. (As illustrated, the X-axis is perpendicular to the ground.) In one embodiment, the side-flow outdoor unit 14 may have a fan 50 that rotates about an axis that is generally parallel to the ground. (As illustrated, the Y- and Z-axes are parallel to the ground.)

Advantageously, the side-flow outdoor unit 14 provides a smaller footprint than traditional up-flow units, which are more cubic in nature. This smaller footprint allows the side-flow outdoor unit to be installed in tighter spaces, where sufficient horizontal spacing for an up-flow unit is not available. For example, the side-flow outdoor unit 14 may be particularly beneficial for heating and/or cooling a residential structure that comes up to or that is very close to the structure's property line.

But the smaller footprint of the side-flow outdoor unit 14 can reduce the available space within the outdoor unit's casing 48—space that is used to mount the equipment that helps circulate and controls the flow of the refrigerant. For example, the described outdoor unit 14 has an accumulator 46 that helps prevents liquid refrigerant from reaching the inlet of a compressor 36. And the outdoor unit 14 has a receiver 42 that helps maintains a sufficient volume of refrigerant in the system. The size of these components is often defined by the amount of refrigerant employed by the system. For example, the receiver may be sized such that it is fifteen percent (15%) larger than the total amount of refrigerant present in the system. Or the system may be designed without a receiver, but it may have an accumulator that is sized for the amount of refrigerant in the system—the accumulator taking up valuable space in the casing 48.

As is discussed further below, the described HVAC system 10 has indoor and outdoor heat exchangers with reduced-diameter tubing, which reduces the refrigerant loops overall volume and, in turn, reduces the amount of refrigerant employed by the system. As a benefit, this allows the various components in the outdoor unit—for example, the receiver and accumulator—to be sized for a lower volume, making them easier to fit within the side-flow outdoor unit's casing 48. It should be appreciated that it is envisaged that certain components located in the outdoor unit—like the receiver, accumulator, flow-control devices, for example—could be disposed in the indoor unit, if so desired.

Figure 2:
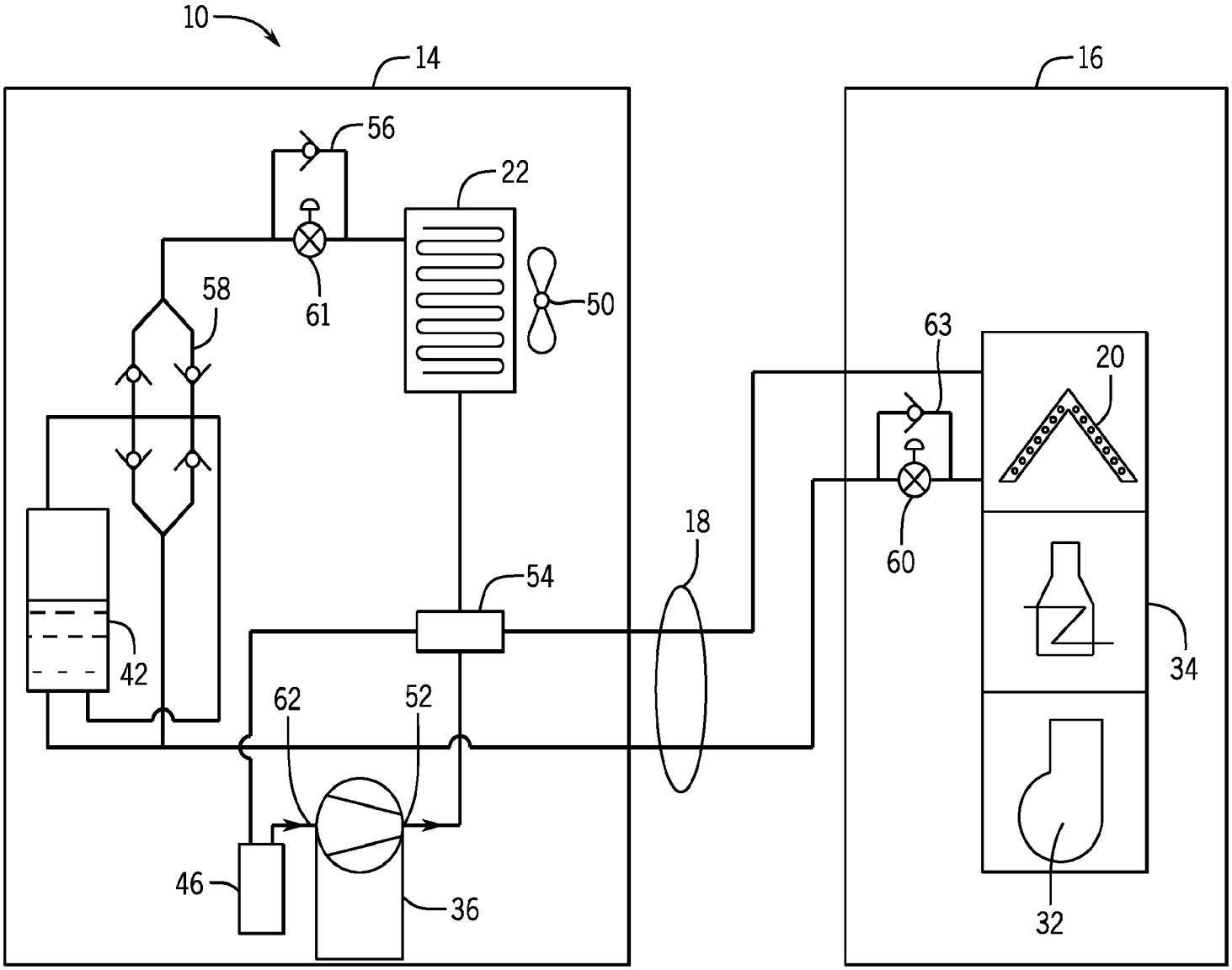
FIG. 2 is a schematic process-and-instrumentation drawing of an HVAC system for heating and cooling indoor spaces within a structure, in accordance with an embodiment of the present disclosure.

FIG. 2 provides further detail about the various components of an HVAC system and their operation. If the HVAC system 10 is cooling the structure 12, the compressor 36 draws in gaseous refrigerant and pressurizes it, sending it into the closed refrigerant loop 18 via compressor outlet 52. This outlet 52 is connected to a reversing valve 54, which may be electronic, hydraulic or pneumatic and which controls the routing of the high-pressure gas to the indoor or outdoor heat exchanger. For cooling, the high-pressure gas is routed to the outdoor heat exchanger 22, where airflow generated by the fan 50 aids the transfer of heat from the refrigerant to the environment causing the refrigerant to condense into a liquid that is at high-pressure.

The refrigerant, which is mostly liquid at this point, leaves the outdoor heat exchanger 22 and progress through a by-pass 56, because the outdoor metering device 61 is in a closed position. From there, the high-pressure liquid refrigerant flows into a series of receiver check valves 58 that manage the flow of refrigerant into the receiver 42. The receiver 42 stores refrigerant for use by the system, and provides a location where residual high-pressure gaseous refrigerant can transition into liquid form. From the receiver 42, the high-pressure liquid refrigerant flows to the indoor unit 16, specifically to a metering device 60 that restricts the flow of the refrigerant to reduce the refrigerant's pressure. That is, the refrigerant leaves the indoor metering device 60 as a low-pressure liquid. The metering device may be one of any number of devices, including capillaries, thermal expansion valves, reduced orifice tubing, to name but a few. Moreover, the metering device may be an electronic expansion valve that allows for precise control of flow through it. In such case, refrigerant flow may be able to bypass through the metering valve rather than through a separate line.

Low-pressure liquid refrigerant is then routed to the indoor heat exchanger 20. As illustrated, the indoor heat exchanger 20 is an "A-coil" style heat exchanger, the details of which are described below. Airflow generated by the blower 32 aids in the absorption of heat from the flowing air by the refrigerant, causing the refrigerant to transition from a low-pressure liquid to a low-pressure gas as it progresses through the indoor heat exchanger 20. And the airflow generated by the blower 32 drives the now cooled air into the ductwork 30, cooling the indoor spaces 28. The refrigerant, which is now mostly a low-pressure gas, is routed to the reversing valve 54 that directs refrigerant to the accumulator. Any remaining liquid in the refrigerant is separated in the accumulator, ensuring that the refrigerant reaching the compressor inlet 62 is almost entirely in a gaseous state. The compressor 36 then repeats the cycle, by compressing the refrigerant and expelling it as a high-pressure gas.

For heating, the process is reversed. High-pressure gas is still expelled from the compressor outlet 52. However, for heating, the reversing valve 54 directs the high-pressure gas to the indoor heat exchanger 20. There, the refrigerant—aided by airflow from the blower 32—transitions from a high-pressure gas to a high-pressure liquid, expelling heat. And that heat is driven by the airflow from the blower 32 into the ductwork 30, heating the indoor spaces 28. If more robust heating is desired, the gas furnace 34 may be ignited, either supplementing or replacing the heat from the heat exchanger. That generated heat is driven into the indoor spaces by the airflow produced by the blower 32.

The high-pressure liquid refrigerant leaving the indoor heat exchanger 20 is routed to an indoor bypass 63, because the indoor metering device 60 is in the closed position. Using the refrigerant lines 18, the high-pressure liquid refrigerant is routed to the receiver check valves 58 and into the receiver 42. As described above, the receiver 42 stores liquid refrigerant and allows any refrigerant that may remain in gaseous form to condense. From the receiver, the high-pressure liquid refrigerant is routed to an outdoor metering device 61, which lowers the pressure of the liquid. Just like the indoor metering device 60, the illustrated outdoor metering device 61 is an electrical expansion valve. But it is envisaged that the outdoor metering device could be any number of devices, including capillaries, thermal expansion valves, reduced orifice tubing, for example.

The lower-pressure liquid refrigerant is then routed to the outdoor heat exchanger 22, which is acting as an evaporator. That is, the airflow generated by the fan 50 aids the transition of low-pressure liquid refrigerant to a low-pressure gaseous refrigerant, absorbing heat from the outdoor environment in the process. The low-pressure gaseous refrigerant exits the outdoor heat exchanger 22 and is routed to the reversing valve, which directs the refrigerant to the accumulator. The compressor 36 then draws in gaseous refrigerant from accumulator, compresses it, and then expels it via the outlet 52 as high-pressure gas, for the cycle to be repeated.

Figure 3:
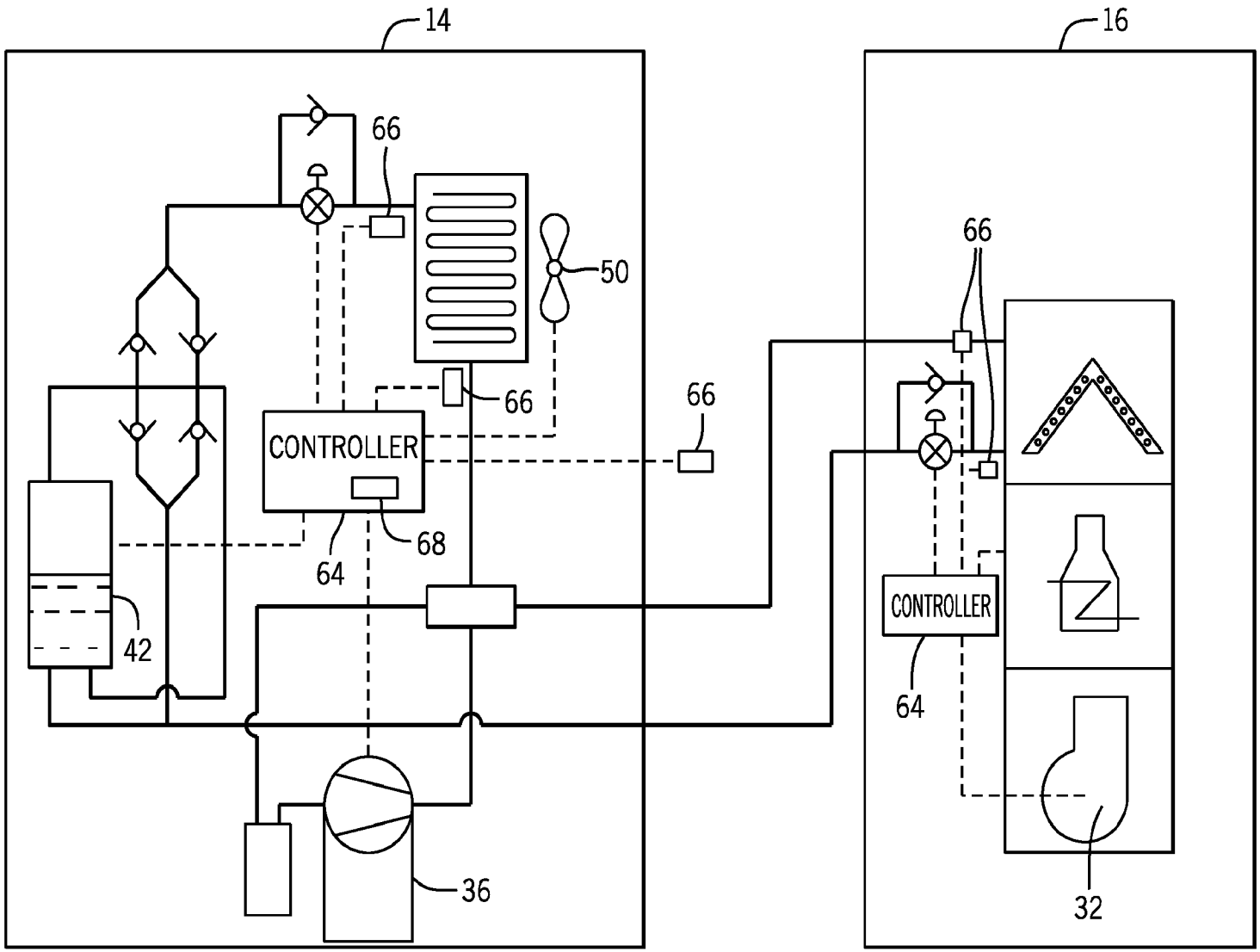
FIG. 3 illustrates schematically a command and control architecture for an HVAC system, in accordance with an embodiment of the present disclosure.

FIG. 3 illustrates the HVAC system 10 of FIG. 2, but provides further information about the HVAC system's control architecture. As illustrated, the HVAC system 10 includes one or more controllers 64 that manage the operating of the HVAC's system's components. Such command and control may be effectuated by any number of well-known protocols, such as open systems like CAN or propriety systems like Daikin Industries Limited's P1/P2 protocol, or a ClimateTalk protocol. Moreover, these command and control communications may be over a wired bus or network, or may be communicated over a wireless network.

The illustrated controller 64—which may be a programmable logic circuit or a processor or integrated circuit with memory, for example—receives input data from a wide variety or sensors located throughout system. Temperature sensors 66 can determine the temperature of the outdoor air, the air within the indoor spaces, or the refrigerant ingressing and egressing from the heat exchangers 20, 22. Moreover, the controller may be in communication with various components of the system—for example, the fan 50, the compressor 36, the receiver 42—that send operation data (e.g., motor speed, liquid level in the receiver) to the controller. In turn, the controller can send informed commands to the components of the HVAC system, to optimize their performance. For example, the controller can optimize operation of the electronic expansion valves 61, the fan 50, the blower, or the compressor 36.

As one particular example, the disclosed controller 64 includes inverter circuitry that varies the speed of the compressor's motor, thereby regulating the amount of refrigerant the compressor pumps. Moreover, the inverter circuitry—which changes the frequency of the current motivating various electronic components like motors—can be used to control the speed of other components, like fans 50 or blowers 32. It is believed that the inverter circuitry can improve the efficiency of the HVAC system in comparison to traditional system, which operate the compressor motor at a single speed and in a binary (on/off) manner.

As shown, the HVAC system 10 has two controllers 64, one for the indoor unit and one for the outdoor unit. However, it is also envisaged that the command of the controllers could be centralized into one controller located in either the indoor or outdoor unit, or it could be decentralized to multiple controllers located throughout the HVAC system, or those controllers may be located at a remote location accessible through a network or the Internet. And if there are multiple controllers, they could be designed to communicate with one another, or could be designed to operate independently.

Focusing on the heat exchangers, FIGS. 4-9 illustrate a variety of heat exchangers that can be employed by the described HVAC system. While a handful of heat exchanger types are described, it is envisaged the techniques described herein are applicable to any number of heat-exchanger types, including heat-pipe heat exchangers; shell-and-tube heat exchangers, wheel heat exchangers, slab-coil heat exchangers, and AWUF CSCF heat exchangers available from Daikin Industries, Ltd., to name but a few.

Figure 5:
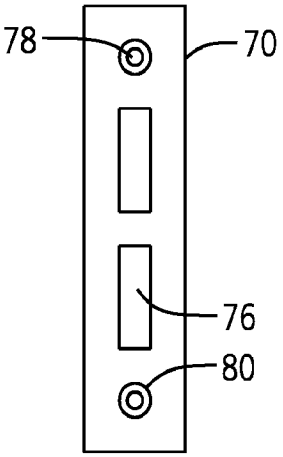
FIG. 5 is a schematic side view of the heat exchanger of FIG. 4.
Figure 4:
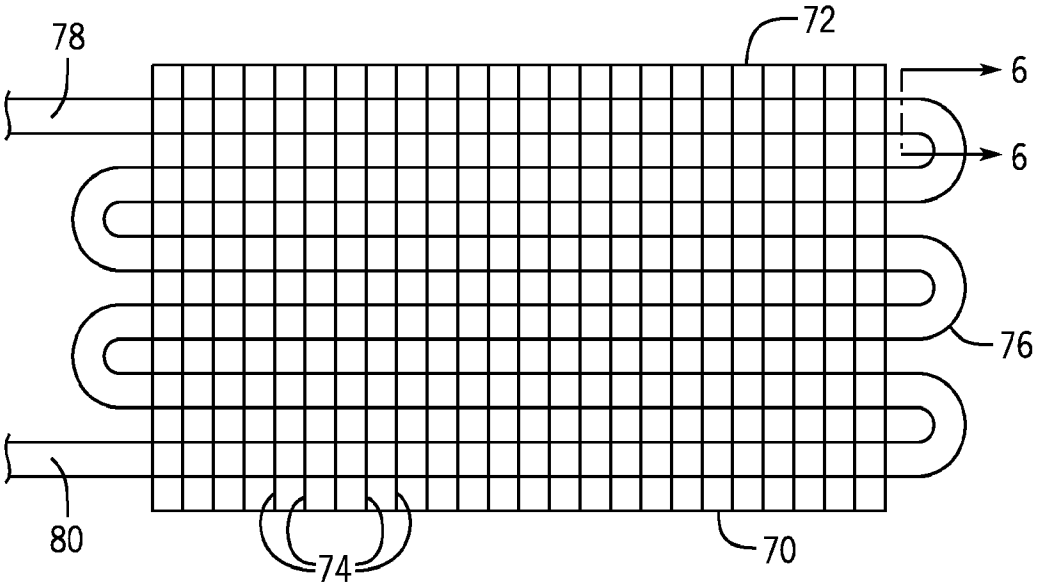
FIG. 4 is a schematic front view of a heat exchanger, in accordance with an embodiment of the present disclosure.
Figure 6:
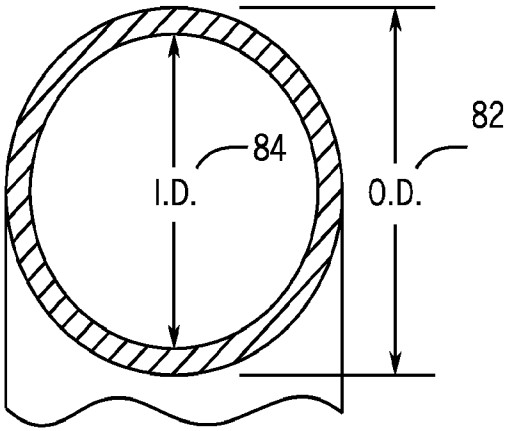
FIG. 6 is a schematic cross-section of the heat exchanger of FIG. 4 along line 6-6.

FIGS. 4-6 illustrate aspects of a traditional fin-and-tube heat exchanger 70. This heat exchanger 70 has a frame 72 that supports a collection of fins 74 through which a coiled tube 76 extends. The coiled tube 76 forms part of the refrigerant loop through which refrigerant for the HVAC system is circulated. Refrigerant enters the heat-exchanger tubing 76 through a first port 78, circulates through coiled tubing either absorbing or releasing heat, and egresses through a second port 80. However, it should be understood that if the first port 78 receives refrigerant during heating operations, then during cooling operations the second port 80 receives the refrigerant.

The heat exchanger tubing 76 has an outer diameter 82 and an inner diameter 84—with industry practice being to name heat exchanger tubing by its outer diameter. Traditional HVAC devices have heat exchangers with tubing that has an outer diameter of % inch (9.525 mm) or more. The relatively large diameter of the tubing increases the overall volume of the refrigerant line 18, thus increasing the amount of refrigerant employed by the HVAC system 10. In the disclosed embodiment, the heat exchanger tubings' outer diameter, in both the indoor and outdoor heat exchangers, are less than traditional sizes.

For example, the outer diameter 80 of the heat exchanger tubing 76 in the outdoor unit may be less than or equal to 8 mm. Indeed, in another potential embodiment the outdoor heat exchanger's tubing has an outer diameter of less than or equal to 7 mm. The outer diameter of the tubing in the indoor heat exchanger may be less than or equal to 9 mm. In one embodiment, the outer diameter of the tubing in the indoor heat exchanger may be less than or equal to 7 mm. (For non-circular tubing, the diameter is defined by the smaller of the cross-sectional dimensions.) The tubing may be formed of any suitable material such as copper or aluminum or copper or aluminum alloys. It is believed that aluminum and aluminum-alloy tubing, because it is thicker, will have a smaller inner diameter than copper tubing with the same outer diameter as the aluminum tubing. Reducing the inner diameter of the tubing reduces the overall volume of the refrigerant lines, which is believed to reduce the amount of refrigerant in the system.

Figure 7:
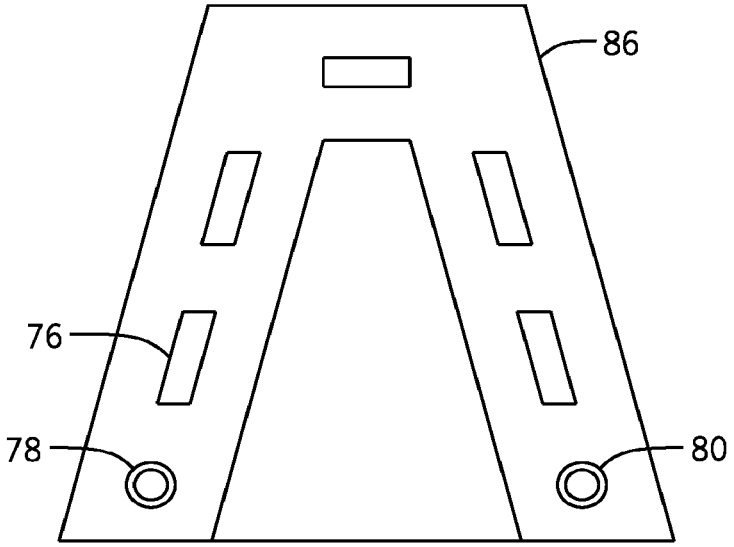
FIG. 7 illustrates schematically an "A-coil" heat exchanger, in accordance with an embodiment of the present disclosure.

FIG. 7 illustrates an "A-coil" style heat exchanger 86 that is typically found in indoor units of ducted HVAC systems. The A-coil heat exchanger 86 comprises a series of fins through which coiled tubing extends. Like the heat exchanger of FIG. 4, the A-coil heat exchanger has first and second ports 78, 80 for the ingress and egress of refrigerant. Advantageously, the shape of the A-coil increases the amount of surface area that is in contact with the air being blown through, for example, the AHU. The outer diameter of the tubing in the A-coil heat exchanger may be less than or equal to 9 mm. In one embodiment, the outer diameter may be less than or equal to 7 mm. That is, in one embodiment, the "A-coil" heat exchanger disposed in an indoor unit may have aluminum tubing that is coiled and that has an outer diameter of 7 mm or less. In other embodiments, other system of heat exchangers disposed in an indoor unit may have aluminum tubing that is coiled and that has an outer diameter of 7 mm or less.

Figure 8:
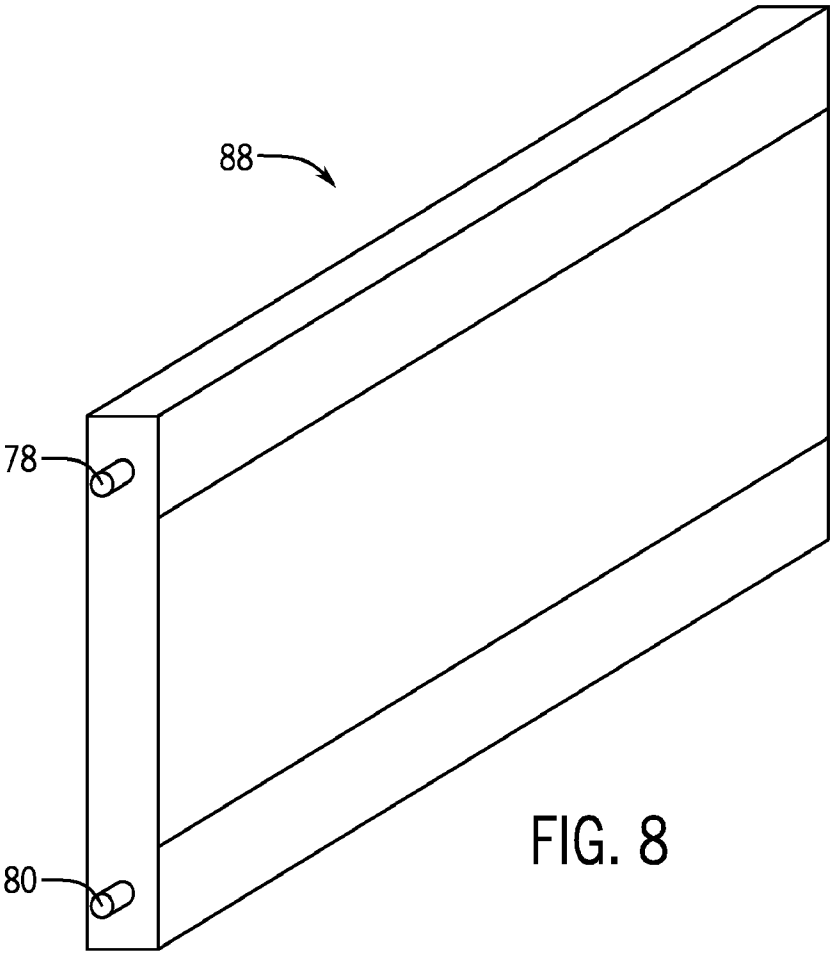
FIG. 8 is a schematic isometric view of a microchannel heat exchanger, in accordance with an embodiment of the present disclosure.
Figure 9:
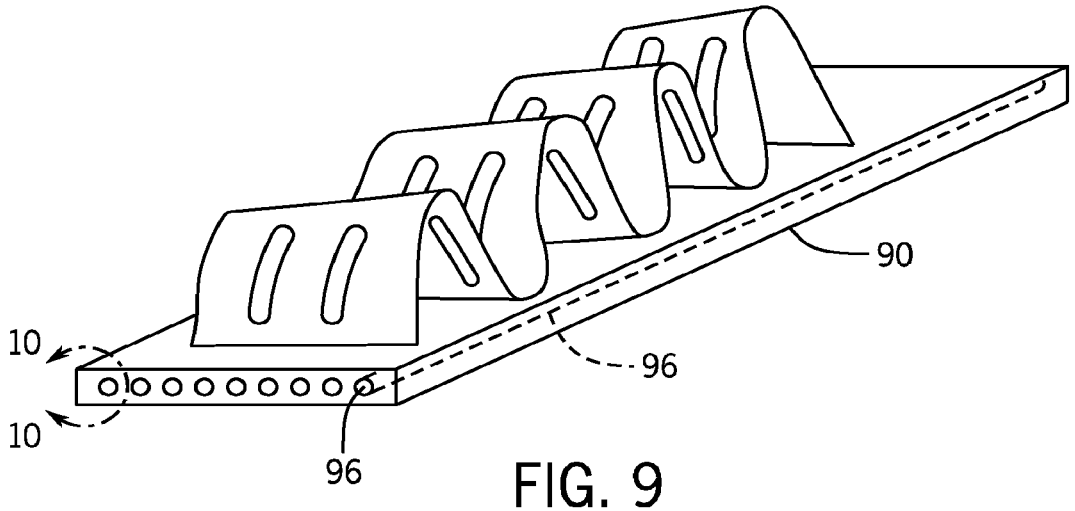
FIG. 9 is a schematic, isometric view of an interior portion of the microchannel heat exchanger of FIG. 8.
Figure 10:
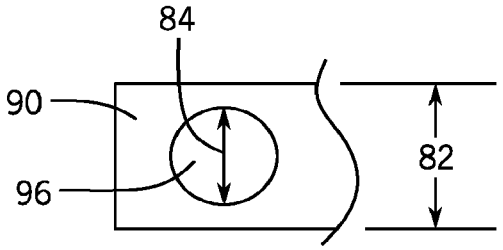
FIG. 10 is a schematic close-up of the heat exchanger of FIG. 9, inside arc 10-10.

FIGS. 8-10 illustrate aspects of a micro-channel heat exchanger 88. Like the other described heat exchangers, the micro-channel heat exchanger has first and second ports that facilitate the ingress and egress of refrigerant through the heat exchanger 88. In this heat-exchanger 88, a series of plates 90 has defined within them axial channel tubing 96 for the flow of refrigerant through the heat exchanger. The outer diameter 82 of a channel 96 may be less than or equal to 9 mm. In other embodiments, the outer diameter is less than or equal to 8 mm or less than or equal to 7 mm. The inner diameter 84 of the channel 96 may be less than or equal to 9 mm, or may be less than or equal to 8 mm, or may be less than or equal to 7 mm.

Figure 11:
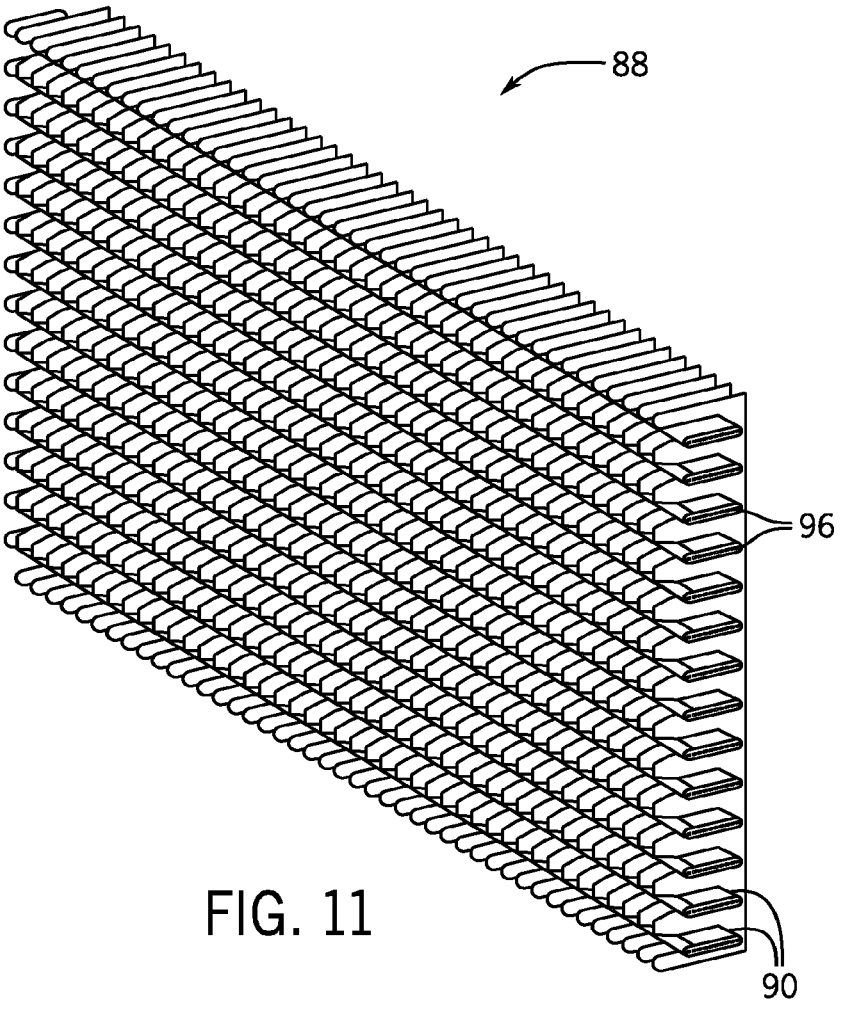
FIGS. 11 and 12 illustrate schematically a microchannel heat exchanger, in accordance with an embodiment of the present disclosure.
Figure 12:
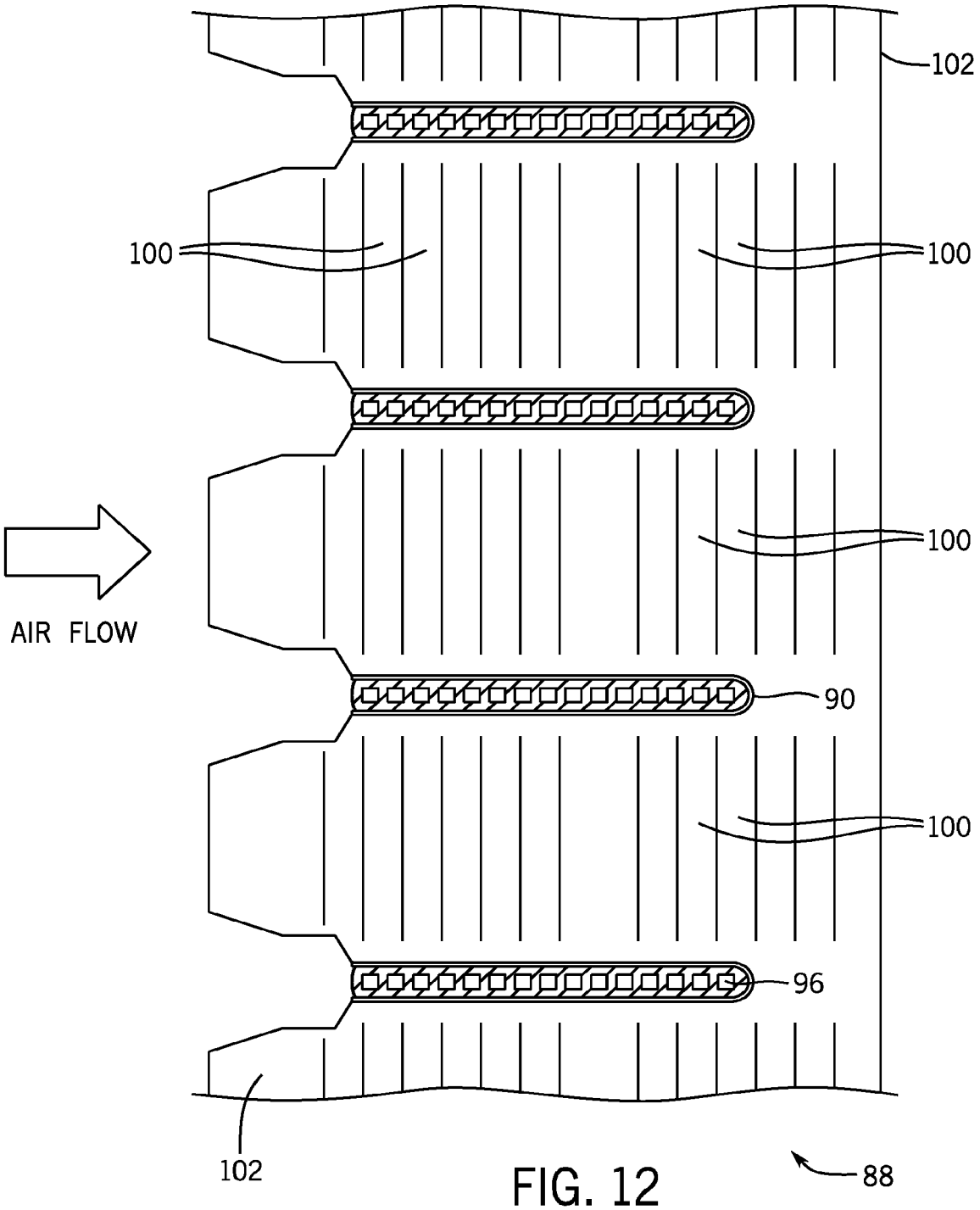

FIGS. 11-12 illustrate another embodiment of the micro-channel heat exchanger 88. In this embodiment, the plates 90, or flat tubes, have axial channel tubing 96 running therethrough for the flow of refrigerant. As shown, these channels are non-circular. Air motivated between the fins 102 transfers heat with the refrigerant running through the tubing 96. To assist this function, the heat exchanger 88 may include louvers 100.

As discussed above, heat exchangers having reduced-diameter tubing reduce the overall volume the refrigerant lines, thereby reducing the amount of refrigerant employed by the system. In turn, this may reduce the size of certain fluid-storage components in the HVAC system, like the receiver 42 and the accumulator 46.

For example, in one embodiment, the HVAC system 10 may be a 3 Ton system with side-flow outdoor unit and with a 1.1 liter (L) accumulator. (Tonnage of a system refers to its cooling capacity, as would be appreciated by those of ordinary skill in the art.) In another embodiment, the HVAC system 10 may be a 5 Ton system with a side-flow unit and a 3.0 L accumulator.

These embodiments are in contrast to traditional systems, in which a 3 Ton system with an up-flow outdoor unit has a 5.0 L or 6.3 L accumulator. Or a traditional 5 Ton system that has an up-flow outdoor unit and has a 6.3 L or 7.4 L accumulator, depending on the system's efficiency rating (SEER). A fluid-receiving component of those sizes take up substantial space within the outdoor unit's casing. It is believed that the reduced-diameter heat exchanger tubing described herein can provide equivalent cooling efficiency and performance with smaller fluid-receiving components, for example.

There are number of refrigerants that can be used by the HVAC system. For example, the system 10 may circulate a single refrigerant, such as R32. Or the system may employ a composite of multiple refrigerants. For example, the system may employ refrigerants with the following composition (by weight):

| Composite Refrigerant | R32 (% weight) | R125 (% weight) | R1234yf (% weight) |
|---|---|---|---|
| DR-55 | 67.0 | 7.0 | 26.0 |
| R410 | 50.0 | 50.0 | 0.0 |
| DR-5 | 72.5 | 0.0 | 27.5 |

As another potential embodiment, the HVAC system may employ a hydrofluoro-olefin (HFO) refrigerant. The employed HFO refrigerant may by of a single type or a composite. For example, the system may employ HFO refrigerants with the following composition (by weight):

| Composite Refrigerant | HFO-1123 (% weight) | R32 (% weight) |
|---|---|---|
| HFO-Mix 1 | 45.0 | 55.0 |
| HFO-Mix 2 | 40.0 | 60.0 |

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An HVAC system for providing conditioned air to a structure, comprising:

a side-flow unit external to the structure comprising a housing and a first coiled-tube heat exchanger disposed within the housing, the first heat exchanger having first tubing with an outer diameter less than or equal to eight millimeters (8 mm);

a second coiled-tube heat exchanger disposed within the structure and configured to be coupled to the first heat exchanger for circulation of a fluid refrigerant between the first and second heat exchangers, the second heat exchanger having second tubing with an outer diameter less than ⅜ inch, wherein the outer diameter of the first tubing is smaller than the outer diameter of the second tubing;

an airflow circulation system configured to circulate air from the structure over the second heat exchanger and then route the air back to the structure via ductworks; and an electronic expansion valve in fluid communication with at least one of the first or second heat exchangers.

2. The HVAC system of claim 1, comprising circuitry configured to provide variable-speed operation of a compressor motor disposed in the side-flow unit.

3. The HVAC system of claim 1, wherein the first and second heat exchangers are coupled via a refrigerant loop such that the second heat exchanger is configured to absorb heat from the structure.

4. The HVAC system of claim 1, wherein the second heat exchanger is configured to absorb heat from and release heat to the structure.

5. The HVAC system of claim 1, comprising a gas furnace configured to cooperate with the airflow circulation system to route heated air back to the structure via ductworks.

6. The HVAC system of claim 1, wherein the fluid refrigerant comprises at least 50%, in terms of weight, R32 refrigerant.

7. The HVAC system of claim 6, wherein the fluid refrigerant at least partially comprises a hydrofluoro-olefin (HFO) refrigerant.

8. The HVAC system of claim 1, wherein the electronic expansion valve restricts a flow of the fluid refrigerant therethrough to reduce a pressure of the fluid refrigerant.

9. An HVAC system for providing conditioned air to a structure, comprising:

a first unit external to the structure comprising a first heat exchanger having tubing with an outer diameter less than or equal to eight millimeters (8 mm), the first unit being a side-flow unit;

a second unit disposed within the structure and comprising a second heat exchanger having non-circular channel tubing with an external diameter of less than eight millimeters (8 mm), the second heat exchanger configured to couple to the first heat exchanger for circulation of a refrigerant between the first heat exchanger and the second heat exchanger, wherein the outer diameter of the non-circular channel tubing of the second heat exchanger is smaller than the outer diameter of the tubing of the first heat exchanger; and at least one electronic expansion valve in fluid communication with at least one of the first heat exchanger and the second heat exchangers;

wherein the first heat exchanger is a coiled-tube heat exchanger and the second heat exchanger is a microchannel heat exchanger.

10. The HVAC system of claim 9, comprising an airflow circulation system configured to circulate air from the structure over the second heat exchanger and then route the air back to the structure via ductworks.

11. The HVAC system of claim 9, comprising circuitry configured to provide variable-speed operation of a compressor motor disposed in the first unit.

12. The HVAC system of claim 9, wherein the outer diameter of the non-circular channel tubing is less than or equal to seven millimeters (7 mm).

13. The HVAC system of claim 9, wherein the second heat exchanger is configured to absorb heat from and release heat to the structure.

14. The HVAC system of claim 9, comprising at least one electronic expansion valve in fluid communication with at least one of the first or second heat exchangers.

* * * * *